United States Patent [19]

Martin

[11] 4,036,731

[45] July 19, 1977

[54] HYDROGENATION OF COAL

[75] Inventor: Terence Geoffrey Martin, Winchcombe, England

[73] Assignee: Coal Industry (Patents) Limited, London, England

[21] Appl. No.: 626,102

[22] Filed: Oct. 28, 1975

[30] Foreign Application Priority Data

Dec. 19, 1974 United Kingdom ..... 54981/74

[51] Int. Cl.[2] ..... C10G 1/06

[52] U.S. Cl. ..... 208/8

[58] Field of Search ..... 208/8, 10

[56] References Cited

U.S. PATENT DOCUMENTS

| | | | |
|---|---|---|---|
| 3,642,607 | 2/1972 | Seitzer | 208/8 |
| 3,687,838 | 8/1972 | Seitzer | 208/10 |
| 3,745,108 | 7/1973 | Schuman et al. | 208/8 |
| 3,819,506 | 6/1974 | Seitzer et al. | 208/8 |
| 3,850,738 | 11/1974 | Stewart et al. | 208/8 |
| 3,920,536 | 11/1975 | Seitzer et al. | 208/10 |
| 3,970,541 | 7/1976 | Williams et al. | 208/8 |
| 3,997,424 | 12/1976 | Urouhart | 208/8 |

OTHER PUBLICATIONS

Fuel, vol. 54, Oct. 1975, "Chemical Nature of a Supercritical Gas Extract of Coal at 350° C.".

*Primary Examiner*—Delbert E. Gantz
*Assistant Examiner*—James W. Hellwege
*Attorney, Agent, or Firm*—Stevens, Davis, Miller & Mosher

[57] ABSTRACT

The present invention relates to a process for the hydrogenative extraction of coal which comprises extracting finely divided coal at an elevated temperature between 340° and 480° C. with a gaseous solvent and a hydrogen donor, which solvent at the extraction temperature is above its critical temperature, separating the gas phase extract from the solids residue when extraction has been completed and thereafter condensing the extracted products from the gaseous or vapor phase. The coal is preferably finely divided such that 90% of the coal particles pass through a 1.5 mm. mesh screen. The solvent may comprise a number of utilizable solvent components and the solvent selected such that the sum of the reduced partial pressures of the utilisable solvent components is greater than 1 at the extraction temperature.

7 Claims, No Drawings

HYDROGENATION OF COAL

This invention relates to a process for the hydrogenation of coal.

It has been proposed to hydrogenate coal with hydrogen gas in the presence of a solvent and a catalyst. At temperatures generally employed for such hydrogenation, hitherto above 300° C. the coal substance breaks down, the molecular chain in the coal being degraded to form lower molecular weight substances. These products often have a molecular size such that they are suitable for use as fuel oils or the like and it has been proposed to subject them to hydrocracking for conversion into synthetic gasoline. The reactions involved in the breakdown of the coal substance may include both the thermal decomposition of the coal substance in the coal and the hydrogenative degradation of the coal substance. In each case a pitch or tar like mixture is formed which is liquid at the temperatures involved and contains compounds having about 20 or more carbon atoms.

It has also been proposed to treat coal with a solvent above the critical temperature, and/or critical pressure of the solvent, i.e. in the gas phase, in the presence of hydrogen whereby hydrogenative degradation takes place and at the same time the degradation products dissolve in the gas phase of the supercritical solvent and the gas phase can be readily separated from the residual ash and other portions of the coal which either have not been degraded or which degraded products are not soluble or have not been dissolved in the gas phase solvent. The extract is then separated from the solvent, for example, by reducing the pressure of the gas phase which often has the effect, particularly if the pressure of the gas phase is below the critical pressure of the solvent, of reducing the solubility of the extract of the coal in the vapour phase of solvent thus obtained. The reduction in pressure, or other separate technique may be effected progressively in a stepwise manner and portions of the extract coal condensed, if appropriate, in stepwise portions.

The use of reactive solvents of a hydrogen donor type for the degradation and dissolution of coal is also generally well known. The chemical mechanism which may account for the enhanced solvent powers of hydrogen donor type solvents is thought to result from the donation of available hydrogen to the degrading coal structure, thereby stabilising the soluble molecular fragments as they are formed. The hydrogen donor in turn reverts to a stable unsaturated form which may subsequently or concurrently be regenerated by conventional hydrogenation techniques.

We have found that by using hydrogen donor as additives to supercritical gases in the gas extraction of coal it is possible to improve the yield of extract significantly over the yields obtained using supercritical gas extraction without hydrogenation.

According to the present invention, there is provided a process for the hydrogenative extraction of coal which process comprises extracting coal at an elevated temperature with a gaseous solvent in the presence of hydrogen donor, separating the gas phase extract from the solids residue and thereafter condensing the extracted products from the gaseous or vapour phase.

The hydrogen donors may be present in the gaseous phase at a temperature below their critical temperature, or in the alternative, they may be present in the gaseous phase at a temperature above their critical temperature.

The hydrogen donor additives should, however, preferably dissolve in the gas phase solvent. Typical hydrogen donors are tetralin, tetrahydroquinoline and o-cyclohexylphenol.

It is preferred that the hydrogen donors or their dehydrogenated products do not irreversibly combine in any way with either the coal extract or the coal residue, but they can be removed from the zone of the extraction with a supercritical gas phase together with soluble coal extract. They may be separated from the coal extract either by making use of solubility differences, (volatilities) in the depressurising supercritical gas, for instance, by concurrent fractionation, or by complete depressurisation of the existing gas phase and recovery by simple distillation. If the hydrogen donor or its dehydrogenated product is of a polar nature, chemical separation processes may be employed.

A hydrogen donor may be used as a simple additive to the supercritical gas phase and on recovery the hydrogen donor or products therefrom may be hydrogenated to product the starting material which may then be recycled. It is preferred, however, to use hydrogen donors together with hydrogen as additives to the supercritical gas phase. The spent donor may then be regenerated in situ and the hydrogen donor and solvent may be recycled for further use. In this way the hydrogen donor present during the extraction tends to act as a hydrogen transfer agent or catalyst for a concurrent gas extraction/hydrogenation process.

In all cases, it is preferred that the hydrogen donor or its dehydrogenated derivative is recovered in high-yields for further treatment if necessary and recycling.

The coal is preferably employed in a finely divided form. It is preferred that the coal particles should pass a 5 mm mesh screen and more preferably a 3.0 mm mesh screen. In particular, it is preferred that at least 90% and preferably 95% of the coal particles should pass a 1.5 mm mesh screen.

The coal solvent and hydrogen donor are preferably admixed at an atmospheric pressure and at temperatures that are not very substantially above ambient temperatures. However, in view of the normal practice to recycle solvents and hydrogen donors or rehydrogenated hydrogen donors, it will not normally be economic to cool the solvent more than is necessary and in consequence, temperatures of the solvent of up to 150° C., or above may be employed during the mixing of the coal with solvent and suitable hydrogen donor.

By the term "gaseous solvent" as used herein is to be understood a solvent which at the extraction temperature is above its critical temperature. The solvent may contain "utilisable solvent components" these "utilisable solvent components" may comprise the whole of the solvent medium or may be present together with components which do not themselves have a solvent action. By utilisable solvent component is meant a solvent component which at the temperature of extraction is above its critical temperature. Thus, the gaseous solvent used in the present invention may comprise one or more utilisable solvent components. Utilisable solvent components in accordance with the present invention may be selected from water, hydrocarbons, organic derivatives of hydrocarbons preferably containing carbon and hydrogen only with no other elements, which components have a critical temperature greater than 150° C. and preferably a critical temperature below about 450° C. Desirably the critical temperatures of such utilisable solvent components is greater than 250° C. The most suitable utilisable solvent components have been found to be those having a critical temperature or less than 400° C. The utilisable solvent components are preferably stable at the extraction temperature, that is to say, they should not decompose substantially at or below the extraction temperature. It is preferred that the utilisable solvent components do not react with the coal or with the hydrogen donor or any catalyst present or with any hydrogen gas which may be present in the extraction vessel.

Certain aromatic compounds particularly polycyclic aromatic compounds may be hydrogenated under the extraction conditions encountered. These hydrogenation compounds themselves may act as hydrogen donors and may constitute the hydrogen donors within the process of the present invention. These hydrogen donors react with the coal substance and degradation products thereof to donate hydrogen thereto and produce an improved yield of hydrogenated products which can be abstracted from the coal.

The reduced partial pressure of any such utilisable solvent component, I, may be at partial pressure $P_i$ at the extraction temperature relevant to its critical pressure $PC_i$ that is to say $P_i/Pc_i$. The sum of the reduced partial pressures of the utilisable solvent components that are above their critical temperatures at the extraction temperature is preferably greater than 1, that is to say, where a single solvent substance is employed that single solvent substance is above its critical pressure. Solvent components that may be employed are preferably those which are stable up to 550° C. under extraction conditions and have critical temperatures within the ranges stated above. Aromatic hydrocarbons having a single benzene ring and preferably not more than 4 carbon atoms in a substituent group may be employed for example benzene, toluene, xylene, ethylbenzene, isopropylbenzene and tetramethylbenzene. Cycloaliphatic carbons may also be employed, preferably those having at least 5 and not more than 12 carbon atoms, for example, cyclopentane, cyclohexane and cis or trans-decalin as well as alkylated derivatives thereof. Aromatic hydrocarbons having two aromatic rings may be employed although it is to be noted that their critical temperatures are relatively high, for example, naphthalene having a critical temperature of 477° C. methylnaphthalene having a critical temperature of 499° C. and biphenyl having a critical temperature of 512° C. and biphenyl methane having a critical temperature of 497° C. Acyclic aliphatic hydrocarbons preferably those having at least 5 and not more than 16 carbon atoms may also be employed for example hexanes, octanes, dodecanes and hexadecanes, the last, for example, having a critical temperature of 461° C.

Aliphatic hydrocarbons used as solvent components should preferably be saturated since the corresponding alkenes would tend to be hydrogenated under the extraction conditions. Phenols may also be employed, preferably those derived aromatic hydrocarbons having up to 8 carbon atoms may be employed, for example phenol, anisole and xylenol; there may, however, be a tendency for the phenolic hydrocarbon group to be reduced under the extraction conditions. Heterocyclic amines such as pyridine may also be employed.

Where present, the hydrogen gas need not be pure and can, for example, be formed by the reaction of steam with carbon, preferably in the form of coke, i.e. water gas.

The proportion of solvent to coal is preferably within the range of 2 to 30 times the weight of coal. The ratio may be held to as low a ratio (below about 10:1) as possible for convenience of handling, but in general the more solvent that is present the more efficient is the extraction of the coal until the limit of extractability is obtained. This is a normal effect in solvent extraction processes but the disadvantages of bulk can be overcome to some extent by the use of a continuous process in which the gas phase moves relative to the coal.

The temperature at which the extraction is carried out is usually below 550° C. and temperatures within the range of 340° C. to 480° C. are preferred, and more preferably of the order of 380° C. to 440° C. In general, the reaction times for hydrogenation are between 15 are between 15 minutes and 45 minutes, but the period may be within the range of 3 minutes to 2 hours depending on the temperatures of hydrogenation and the extraction that are employed. Where higher extraction temperatures are employed, the rate of heating from 380° C to the extraction temperature can be of importance; in the rate of heating should be at a rate sufficiently slow, of the order of 3° to 6° C rise per minute, to permit extraction at a given temperature to proceed to completion as the temperature slowly rises thus reducing coking of the extract to a minimum.

Following is a description by way of example only of methods of carrying out the process of the present invention:

EXAMPLE 1

A bed of coal (CRC 802) having the following properties:

| Moisture | Ash | VM (daf) | C | H | O | N | S |
|---|---|---|---|---|---|---|---|
| 8.0% | 3.7% | 37.9% | 83.3% | 5.3% | 8.3% | 1.75% | 1.35% |

of size range −10 + 72 BSS was confined in a tubular autoclave with a small amount of solvent consisting of 90 parts by weight of toluene and 10 parts by weight of tetralin as hydrogen donor and in a proportion of one part of solvent by weight to one part by weight of coal. The autoclave was rapidly heated at a rate of 100° C. per minute to a temperature of 380° C. in a fluidised sand heater and at this point a flow of the toluene/tetralin solvent of 7g/minute was introduced. The coal bed was maintained at 380° C. for 40 minutes while extractable material was removed in the supercritical gas phase. The gas phase was passed through a condensation train and the extracted coal constituents were recovered in 22.6% yield by weight of coal by distilling the toluene/tetralin + naphthalene at 250° C. and 60T. G.L.C. analysis of the recovered distillate revealed that 10% of the tetralin had been dehydrogenated to naphthalene during the extraction process.

EXAMPLE 2

The conditions of Example 1 were repeated exactly, the solvent in this run was 100% toluene. The yield of extracted coal constituents recovered measured 19%.

EXAMPLE 3

The conditions of Example 1 were repeated exactly, but for the temperature of extraction which was elevated to 420° C. The yield of extracted coal constituents measured 32.6% while G.L.C. analysis revealed a 20% conversion of tetralin to naphthalene.

EXAMPLE 4

The conditions of Example 3 were repeated exactly, the solvent in this run comprising 100% toluene, however. The yield of extracted coal constituents recovered measured 24%.

EXAMPLE 5

Example 1 was repeated using toluene alone. The extraction temperature was increased from 380° C to 420° C at ~ 4° C/minute, an extract field of 28.4% was obtained. The example was repeated with Toluene plus 10% Tetralin and a yield of 32.4% was obtained. A further run with Toluene plus 10% THQ gave an extract yield of 37.1%.

EXAMPLE 6

Example 5 was repeated using an extraction temperature of from 380° C to 440° C at ~ 4° C/minute. With Toluene a 27.4% yield of extract was obtained, with Toluene plus 10% Tetralin a 35.5% field was obtained and with Toluene plus 10% THQ a field of 37.9% of extract was obtained.

I claim:

1. A process for the hydrogenative extraction of coal characterized by extracting coal with an organic solvent in the presence of a hydrogen donor at a temperature greater than the critical temperature of said solvent, said temperature being within the range of 340° C to 480° C, separating the gas phase extract from the solids residue, and condensing the extracted products from the gaseous or vapor phase.

2. A process as claimed in claim 1 characterized in that the hydrogen donor is dissolved in the gas phase solvent.

3. A process as claimed in claim 1 characterised in that the coal is finely divided such that at least 90% of the coal particles pass a 1.5 mm mesh screen.

4. A process as claimed in claim 1 characterized in that the sum of the reduced partial pressure of the solvent components is greater than 1.

5. A process as claimed in claim 4 characterized in that the solvent component is selected from the group consisting of benzene, toluene, xylene, ethyl benzene, isopropylbenzene and tetramethylbenzene.

6. A process as claimed in claim 1 characterized in that the proportion of solvent is less than ten times the weight of coal.

7. A process as claimed in claim 1 characterized in that the extraction is carried out at a temperature within the range of 380° C to 440° C for a period within the range of 3 minutes to 2 hours.

* * * * *